US006042427A

United States Patent [19]

Adriaenssens et al.

[11] Patent Number: 6,042,427

[45] Date of Patent: Mar. 28, 2000

[54] COMMUNICATION PLUG HAVING LOW COMPLEMENTARY CROSSTALK DELAY

[75] Inventors: Luc W. Adriaenssens, Red Bank, N.J.; Lyndon D. Ensz, Omaha, Nebr.; Wayne D. Larsen, Indianapolis, Ind.; Chen-Chieh Lin, Indianapolis, Ind.; Julian R. Pharney, Indianapolis, Ind.; Jamie R. Arnett, Fishers, Ind.

[73] Assignee: Lucent Technologies Inc., Murray Hill, N.J.

[21] Appl. No.: 09/109,125

[22] Filed: Jun. 30, 1998

[51] Int. Cl.[7] ..... H01R 23/02

[52] U.S. Cl. ..... 439/676

[58] Field of Search ..... 439/418, 676, 439/941; 379/417

[56] References Cited

U.S. PATENT DOCUMENTS

| | | | |
|---|---|---|---|
| 4,904,209 | 2/1990 | Nelson | 439/676 |
| 5,186,647 | 2/1993 | Denkmann et al. | 439/395 |
| 5,586,914 | 12/1996 | Foster | 439/676 |
| 5,697,815 | 12/1997 | Drewnicki | 439/676 |
| 5,716,237 | 2/1998 | Conorich | 439/941 |
| 5,766,043 | 6/1998 | Talend | 439/676 |
| 5,911,602 | 7/1997 | Vaden | 439/676 |

OTHER PUBLICATIONS

U.S. Patent Application Serial No. 08/922,580; Filed Sep. 3, 1997, entitled *"Low Crosstalk Assembly Structure For Use In A Communication Plug"*, Inventors: Larsen; Lin; Pharney; and Reichard.

U.S. Patent Application Serial No. 09/047,870; Filed Mar. 25, 1998, entitled *"Crosstalk Compensation for Connector Jack"*, Inventors: Pharney; and Reed.

*Primary Examiner*—Renee S. Luebke
*Assistant Examiner*—Javaid Nasri

[57] ABSTRACT

A communication plug that generates crosstalk that complements the compensating crosstalk in a legacy jack or connector. The communication plug includes a dielectric carrier on which a plurality of electrical conductors are disposed. Each conductor is configured to wrap around a first end of the carrier thereby forming a series of adjacent inductive loops. Complementary crosstalk is generated between the conductors as a result of the fields created from current flow through the inductive loops and can be fixed to a desired level by modifying certain engineerable parameters. The inductive loops are positioned in the nose or front region of the plug where the conductors engage the jack spring wires or terminals thus minimizing the propagation delay between the crosstalk signals generated in the plug and the crosstalk signals generated in the jack or connector.

19 Claims, 3 Drawing Sheets

COMMUNICATION PLUG HAVING LOW COMPLEMENTARY CROSSTALK DELAY

BACKGROUND OF THE INVENTION

The present invention relates generally to the field of modular communication plugs and, more particularly, to the generation of complementary crosstalk in a communication plug such that performance with connector jacks is optimized.

Telecommunications and data transmission systems have evolved in recent years to accommodate the increasing demand for high speed, multi-media services. Accordingly, higher and higher frequencies are being transmitted across network infrastructure originally designed for lower throughput. Although present day cables and wiring, can, theoretically, handle such increased frequencies and traffic volume, the wiring paths themselves become, in effect, antennae that both radiate and receive electromagnetic radiation, thereby creating crosstalk problems. Crosstalk is particularly problematic in systems incorporating multiple wire pairs. Unfortunately, the plugs and jacks that are most commonly used in interconnecting cables and hardware, such as distribution modules, generally include up to eight wires (four wire pairs) that are necessarily oriented both parallel and close together, a condition that leads to excessive crosstalk, even over short distances, and which is exacerbated as the frequency of the signals or the data rate is increased.

Various techniques have been used for reducing crosstalk in communication plugs and cables, such as shielding individual pairs, helically winding twisted pairs, or, where possible, increasing the physical separation of one pair from another. The crosstalk problem, however, cannot be managed through a simple minimization or reduction approach. While it may be desirable in future applications to eliminate virtually all crosstalk in a communication plug, legacy systems (i.e., current jacks) require a predetermined amount of crosstalk in the plug for optimum performance. Legacy jacks are engineered to compensate for crosstalk in the communication plug; thus, a well designed plug should generate crosstalk that is complementary to that used in the jack so the combination of the two crosstalk signals cancel each other out.

For the crosstalk signals generated in the plug and the jack or connector to be completely complementary, they should be of equal magnitude and be 180° out of phase with one another. The crosstalk signals generated in the plug and the jack are separated initially by some defined distance, which results in a propagation time delay before the signals combine. This propagation delay can cause the phase difference between the two crosstalk signals to shift from the desired 180° to some other value, which prevents the plug and jack crosstalk signals from completely canceling one another out. It is therefore desirable, that the complementary crosstalk in the plug be generated proximal to the jack to minimize the propagation delay for the complementary crosstalk signals.

Thus, what is sought is a communication plug having engineerable parameters that can be modified to generate a desired level of crosstalk to adapt to the compensating crosstalk characteristics of a jack or connector in which the plug will be used. Preferably, the communication plug generates the crosstalk near the plug-jack interface to minimize the propagation delay between the crosstalk signals from the respective components.

SUMMARY OF THE INVENTION

Certain advantages and novel features of the invention will be set forth in the description that follows and will become apparent to those skilled in the art upon examination of the following or may be learned with the practice of the invention.

The present invention is generally directed to a communication plug that generates crosstalk that complements the compensating crosstalk in a legacy jack or connector. In a preferred embodiment, the communication plug comprises a dielectric carrier on which a plurality of electrical conductors are disposed. Each conductor is configured to wrap around a first end of the carrier thereby forming a series of adjacent inductive loops. Crosstalk is generated between the conductors as a result of the fields created from current flow through the inductive loops.

According to an aspect of the invention, the complementary crosstalk generated in the plug can be fixed to a desired level by modifying certain engineerable parameters such as the direction that each conductor loops around the end of the carrier. Other engineerable parameters include the length of the inductive loops, the design of the dielectric carrier, and the type of material from which the carrier is made. Advantageously, the inductive loops are positioned in the nose or front region of the plug where the conductors engage the jack spring wires or terminals. As a result, propagation delay between the crosstalk signals generated in the plug and the jack or connector is minimized thus enhancing the effectiveness of the crosstalk compensation design.

The communication plug according to the present invention can optionally include means for complementing the impedance profile of a jack or connector. By matching the impedance of the plug and jack system to that of the nominal impedance of the cable, signal loss due to reflections, and unwanted noise due to said reflections, are minimized. In a preferred embodiment, the impedance matching means comprises parallel plates disposed on certain conductors to create a capacitance within the plug.1

BRIEF DESCRIPTION OF THE SEVERAL VIEWS OF THE DRAWINGS

Other features of the present invention will be more readily understood from the following detailed description of specific embodiments thereof when read in conjunction with the accompanying drawings, in which.

DETAILED DESCRIPTION OF THE PREFERRED EMBODIMENT

Figure 1:
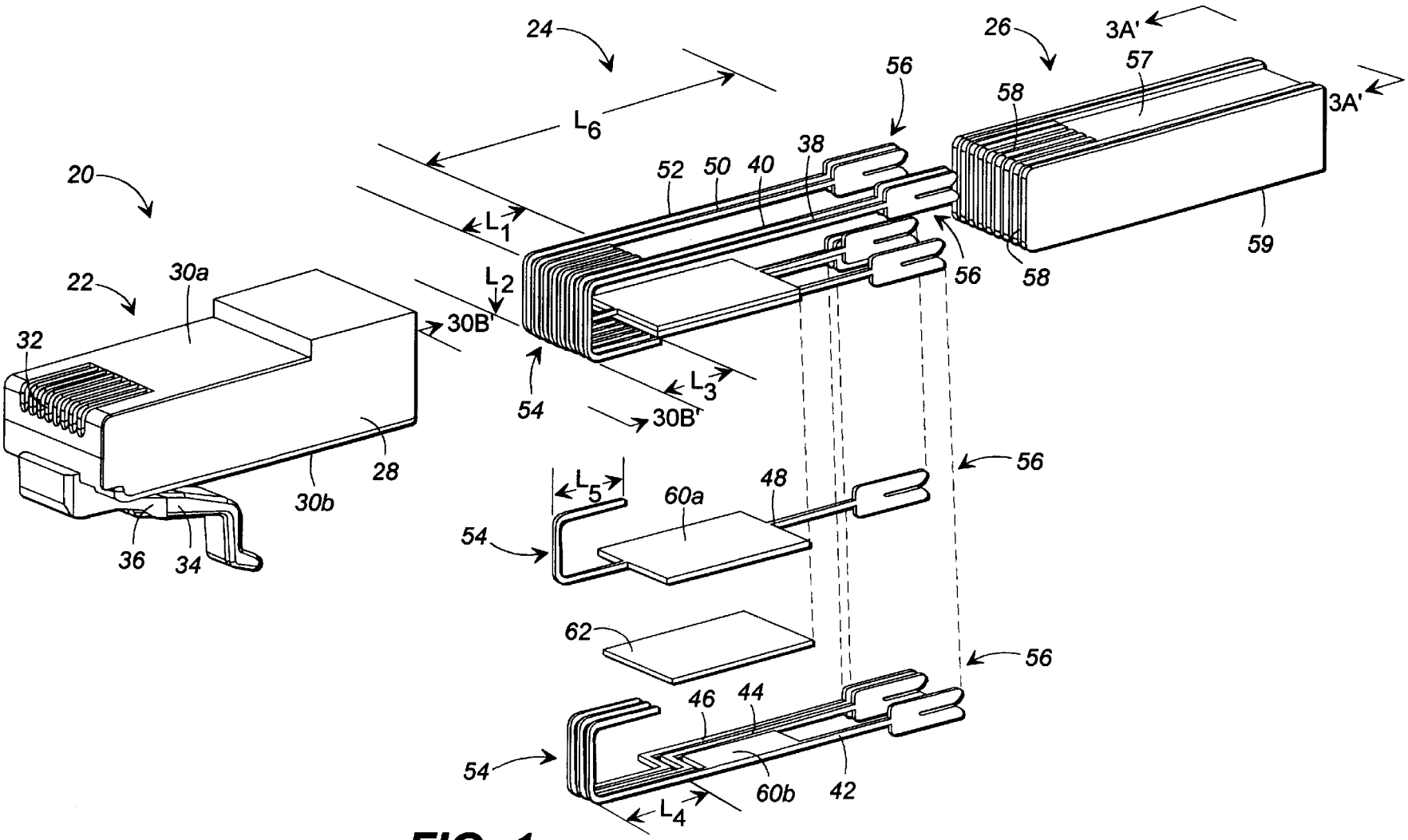
FIG. 1 is an exploded isometric view of a communication plug according to the present invention.

While the invention is susceptible to various modifications and alternative forms, a specific embodiment thereof is shown by way of example in the drawings and will herein be described in detail. It should be understood, however, that there is no intent to limit the invention to the particular form disclosed, but on the contrary, the invention is to cover all modifications, equivalents, and alternatives falling within the spirit and scope of the invention as defined by the claims.

Figure 2:
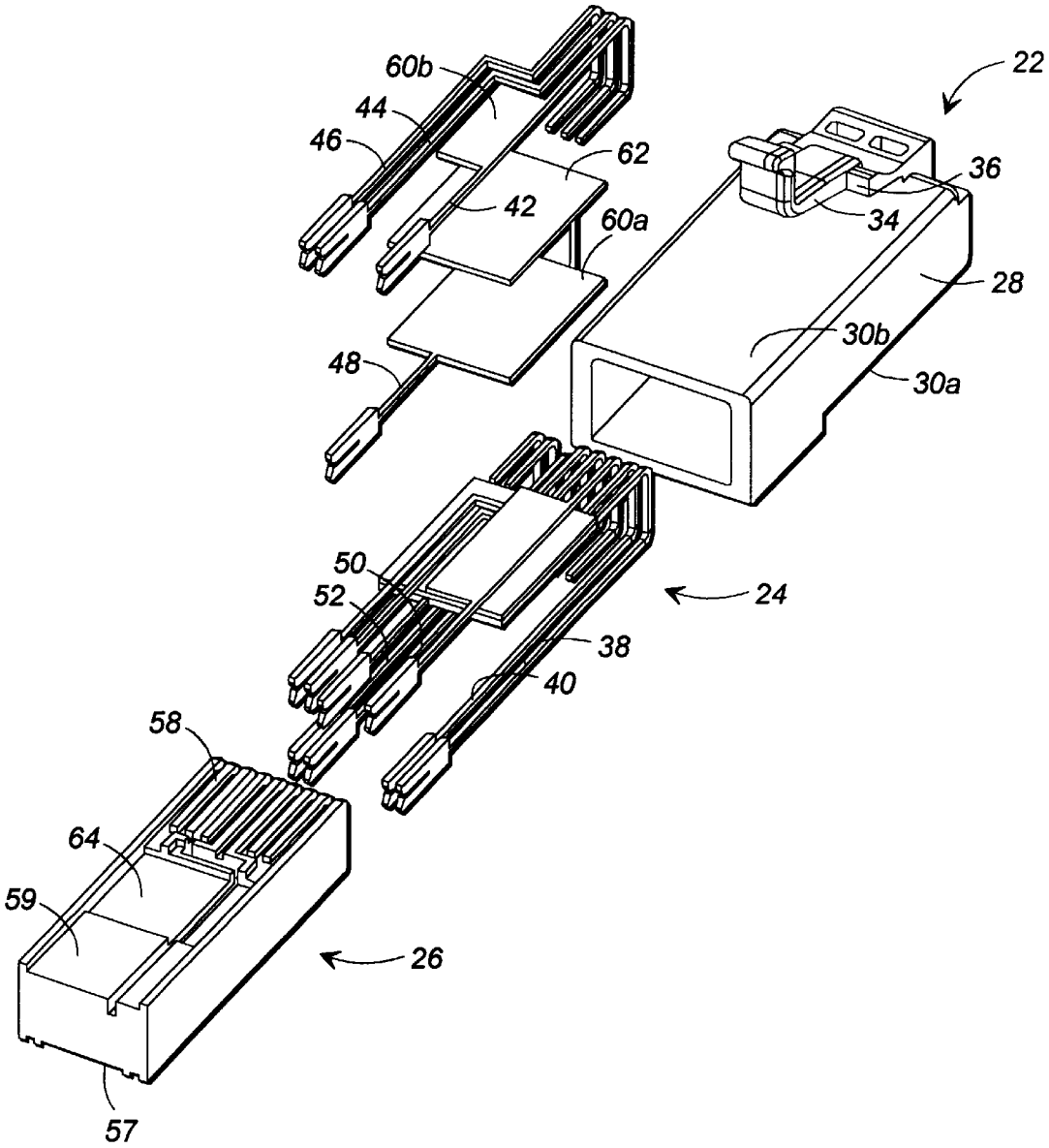
FIG. 2 is an exploded isometric view of the communication plug of FIG. 1 illustrating the underside of the plug.

Referring now to FIGS. 1 and 2, a communication plug 20 embodying the principles of the present invention is shown to comprise a housing 22, a plurality of conductors 24, and a conductor carrier 26. Housing 22, which is typically made from a suitable dielectric material such as plastic, comprises a substantially hollow shell having side walls 28 and upper and lower walls 30*a* and 30*b* respectively. Upper wall 30*a* includes a plurality of slots 32 at the nose or front end of the housing for receiving jack springs contained in a wall terminal block or other connector containing a jack interface with which the plug of the invention is designed to mate. The number of slots 32 and the dimensions of housing 22 are dependent on the number of conductors to be terminated and/or connected and the shape of the jack in the terminal block. For most applications, the general shape of housing 22 remains consistent with the number of slots and the overall width thereof varies in relation to the number of conductors.

To secure communication plug 20 in a jack, housing 22 includes a resilient latch 34 extending from lower wall 30*b*. Because latch 34 is secured to housing 22 at only one end, leverage may be applied to the latch to raise or lower locking edges 36. When housing 22 is inserted into a jack, pressure can be applied to latch 34 to raise locking edges 36 for easy entry. Once housing 22 is seated within the jack, latch 34 can be released causing locking edges 36 to be held behind a plate forming the front of the jack, which is generally standard on such jacks, thereby securing the connection. Similarly, housing 22 can be released via leverage on latch 34 to free locking edges 36 from behind the jack plate so that housing 22 can be removed.

Figure 3A:
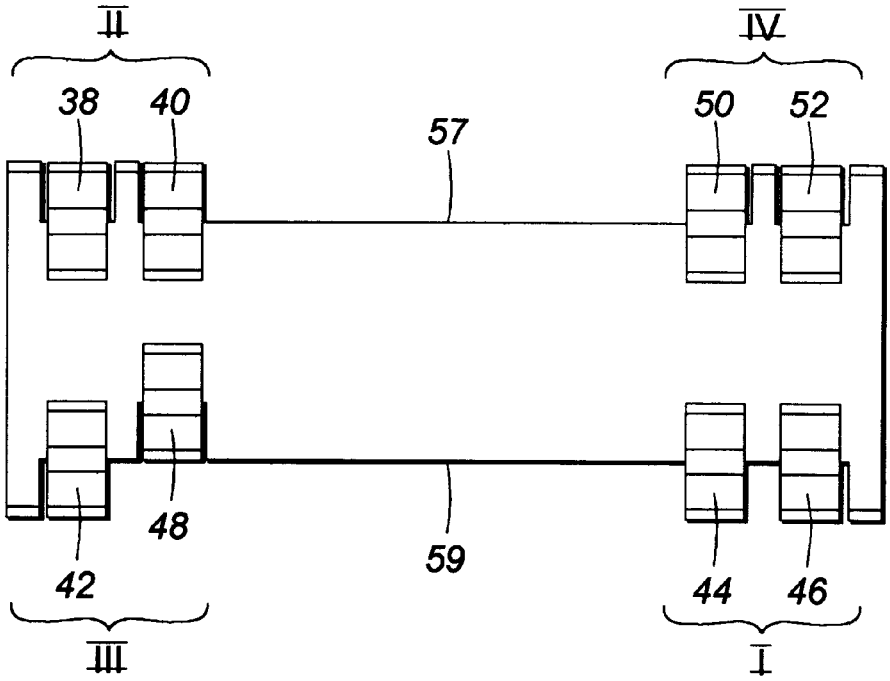
FIG. 3A is an elevation view of the communication plug of FIG. 1 taken along line 3A'–3A' of FIG. 1 and illustrating the arrangement of the insulation displacement connector (IDS) ends of the conductors.
Figure 3B:
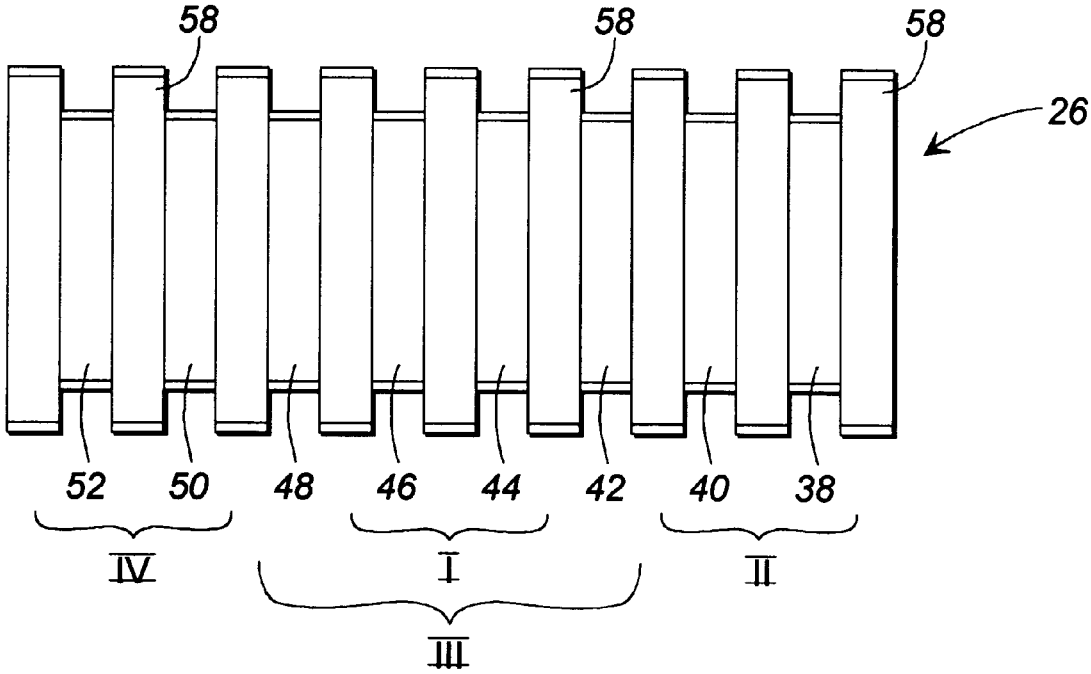
FIG. 3B is an elevation view of the communication plug of FIG. 1 taken along line 3B'–3B' of FIG. 1 and illustrating the arrangement of the conductors at the nose or front end of the plug.

The internal components of communication plug 20 include conductors 24 and conductor carrier 26. Carrier 26 is made from a dielectric material, such as plastic, and has channels and depressions formed thereon to receive the individual conductors 24. The arrangement of conductors 24 once assembled in carrier 26 is shown best in FIGS. 3A and 3B. FIG. 3A depicts the IDC ends of conductors 24 extending from the rear or back end of carrier 26. Similarly, FIG. 3B depicts the jack spring interface ends of conductors 24 arranged at the nose or front of carrier 26. The principles of the invention are disclosed as applied to an eight wire communication plug. Those skilled in the art will appreciate that the concepts taught herein can be applied to plugs terminating cables carrying any number of conductors or wires in which crosstalk is generated in both the plug and the jack or connector. Nevertheless, eight wire cables are generally configured as four wire pairs. These wire pairs map into conductors 24 as shown in FIGS. 3A and 3B: pair I comprises conductors 44 and 46 (hereinafter pair 44–46); pair II comprises conductors 38 and 40 (hereinafter pair 38–40); pair III comprises conductors 42 and 48 (hereinafter pair 42–48); and pair IV comprises conductors 50 and 52 (hereinafter pair 50–52). It should be noted that the pair numbering used herein is for example only. The principles of the present invention apply to any numbering scheme or pair assignment. Pairs 42–48 and 44–46 generally have the largest amount of crosstalk generated in plug 20 because the conductors in pair 42–48 must be split to straddle the conductors of pair 44–46 (see FIG. 2B), which is a common standard in eight conductor plugs. As discussed hereinbefore, the crosstalk is generated not only between pairs 44–46 and 42–48, but between all pair combinations, and should be engineerable to complement the crosstalk generated in the jack or connector. Thus, communication plug 20 should have some means for fixing the amount of crosstalk generated between each pair combination.

Returning to FIGS. 1 and 2, conductors 24 are each shown to have a loop end 54 and an IDC end 56. Loop ends 54 are received in channels defined in the nose or front of carrier 26 by guide walls 58. IDC ends 56 rest at the rear or back end of carrier 26 with each contact being bifurcated to comprise dual, elongated prongs forming a narrow slot therebetween. The tips of the dual prongs are beveled to facilitate reception of an insulated wire from the cable and the inner edges of the prongs have sharp edges for cutting through the conductor insulation. Loop ends 54 are the primary means by which complementary crosstalk is engineered in communication plug 20. It can be seen that loop ends 54 are positioned close together such that a series or array of inductive loops is formed whereby electrical alternating current flow in one loop generates an electromagnetic field that triggers current flow in neighboring loops. The direction of the electromagnetic field and the direction of the current flow are related. Moreover, loops 54 are located in substantially parallel planes with one another, which produces the greatest inductive interaction. Also, the proximity of the conductors in this region gives rise to capacitance between the conductors, which generates crosstalk.

Thus, plug designers have several engineerable parameters at their disposal in the region defined by lengths $L_1$, $L_2$, and $L_3$, which comprise loops 54, to adjust the amount of complementary crosstalk generated. The first parameter is selection of which conductors run along the top 57 of carrier 26, and which run along the bottom 59. As shown in FIGS. 1 and 2, conductors 38, 40, 50, and 52 (i.e., pairs II and IV) extend along the top 57 of carrier 26 with ends 54 looping around the nose and terminating on the bottom 59 of carrier 26. Conversely, conductors 44, 46, 42, and 48 (i.e. pairs I and III) extend along the bottom 59 of carrier 26 with ends 54 looping around the nose and terminating along the top 57 of carrier 26. In conductors 38, 40, 50 and 52, the current runs along the top 57 of the carrier 26 only, and in conductors 44, 46, 22, and 48 the current runs along the bottom 59 of carrier 26 and up the front or nose of carrier 26 (i.e., along length $L_2$). As discussed in the foregoing, the electromagnetic field, and hence the inductively coupled crosstalk, is directly related to the current flow in the conductor. Also, the capacitive coupling is related to the proximity of the respective conductors to one another. Hence, through careful selection of the locations of the conductors, a near optimum crosstalk conduction can be achieved, which can be further optimized by selection of the other parameters. One particular set of conductor locations is disclosed herein as a preferred embodiment. It should be understood that implementations using other sets of conductor locations in which crosstalk conduction is optimized as taught hereafter are within the spirit of the present invention.

Second, the length $L_4$ over which the inductive loops of pairs 44–46 and 42–48 are closely spaced can be adjusted. This has a direct effect on the amount of inductively coupled crosstalk and capacitively coupled crosstalk generated between pairs 44–46 and 42–48 in the loop 54 region (i.e., along lengths $L_1$, $L_2$, and $L_3$). Third, the length $L_5$ of the non-current carrying extensions of all eight conductors can be varied independently to alter their capacitive coupling. A fourth parameter for managing crosstalk in communication plug 20 is the design of carrier 26 and the material from which carrier 26 is made. Carrier 26 is generally made from a dielectric material such as plastic, which increases capacitance, and hence crosstalk between conductor pairs. It is desirable to generate substantially all of the complementary crosstalk at the nose or front of communication plug 20 and to minimize crosstalk in the body of the plug to minimize the propagation delay between the complementary crosstalk in the plug and the compensating crosstalk from the jack or connector. Thus, carrier 26 is generally designed to maximize the electrical segregation of conductors 24 in the region identified as $L_6$ in FIG. 1, which begins with the termination of loop ends 54 and extends to the IDC ends of conductors 24.

It will be appreciated by those skilled in the art that the present invention generates complementary crosstalk in the communication plug predominantly along the region defined by lengths $L_1$, $L_2$, and $L_3$ through inductive loop ends 54, and through capacitive unbalance in this region. Advantagely, the complementary crosstalk is generated at the junction where communication plug 20 engages the jack springs of a jack or connector thus minimizing any signal propagation delay and facilitating the elimination of crosstalk in the system with proper compensation techniques.

In addition to generating the appropriate complementary crosstalk, the mated combination of plug 20 and its jack is also required to meet certain return loss requirements as prescribed in standards set forth by the International Electrotechnical Commission (IEC) and Telecommunication Industry Association (TIA). These standards effectively place limits on the impedance of the plug. Furthermore, it is well known that to minimize return loss of a mating communication plug and a jack or connector, the impedance of the connection point should match that of the cabling it is used with. Accordingly, capacitive plates 60*a* and 60*b* are designed into conductors 48 and 42 respectively (i.e., pair 42–48) to manage the impedance of the mated combination of the jack or connector and plug 20, and to comply with IEC and TIA standards. Dielectric spacer 62. which is typically made from plastic having a high dielectric constant, separates plates 60*a* and 60*b* to form a capacitor. Dielectric spacer 62 can be frictionally held between plates 60*a* and 60*b* and/or secured with an adhesive. The bottom 59 of carrier 26 includes a recessed region 64 for receiving plates 60*a*, 60*b*, and spacer 62. Other means can also be used for separating plates 60*a* and 60*b*. For example, it is common to use a dielectric adhesive tape on the underside of plate 60*a* to fulfill the role of spacer 62. The size of plates 60*a* and 60*b*, the size of dielectric spacer 62, and the type of material spacer 62 is made from can all be modified to adjust the capacitance level. Moreover, plates 60*a* and 60*b* can alternatively be designed from discrete components and placed in proximity to the desired conductors with proper support from carrier 26.

Note that dielectric spacer 62 causes conductor 48 to be offset slightly from the remaining conductors in pairs 44–46 and 42–48 as shown in FIGS. 2 and 3A. The skilled practitioner will recognize that alternative means can be used to adjust the impedance and capacitance developed in communication plug 20 such as alternative plate designs, routing the conductors close together to form capacitive regions, and designing resistive regions in conductors 24, which could change the spatial configuration of both conductors 24 and/or carrier 26.

The principles of the present invention have been illustrated herein as embodied in a communication plug for a multi-wire cable. From the foregoing, it can readily be seen that the communication plug can be engineered during the design process to generate complementary crosstalk to match the characteristics of the jack or connector to which the plug will be mated. Most importantly, however, the complementary crosstalk is generated at the nose or front of the plug where the conductors engage the jack springs in the jack or connector thus minimizing any signal propagation delay and maximizing the effectiveness of the crosstalk compensation design. Several engineerable parameters are identified that can be adjusted during the design and manufacturing phases of the plug to fix the complementary crosstalk level.

In concluding the detailed description, it should be noted that it will be obvious to those skilled in the art that many variations and modifications can be made to the preferred embodiment without substantially departing from the principles of the present invention. All such variations and modifications are intended to be included herein within the scope of the present invention, as set forth in the following claims.

We claim:

1. A communication plug for interconnecting a cable to a jack, said communication plug comprising:

a dielectric carrier, said carrier having a top side, a bottom side, a front end adapted to engage the jack, and a back end adapted to engage the cable;

first and second groups of electrical conductors disposed on said carrier, each of said conductors having a first end and a second end, said first end of each of said conductors of said first group of conductors being oriented adjacent said back end of said carrier, each of said conductors of said first group of conductors extending from said back end of said carrier along said bottom side of said carrier, around said front side of said carrier, and terminating on said top side of said carrier such that each of said second ends of said first group of conductors is oriented between said front side of said carrier and said back end of said carrier; and said first end of each of said second group of conductors being oriented adjacent said back end of said carrier, each of said conductors of said second group of conductors extending from said back end of said carrier along said top side of said carrier, around said front side of said carrier, and terminating on said bottom side of said carrier such that each of said second ends of said second group of conductors is oriented between said front side of said carrier and said back end of said carrier.

2. The communication plug of claim 1, wherein electrical separation of said conductors is maximized in a region between said second ends of said first group of conductors and said first ends of said second group of conductors such that crosstalk of said conductors is concentrated towards said front end of said carrier.

3. The communication plug of claim 1, wherein each of said first ends of said conductors is configured as an insulation displacement connector.

4. The communication plug of claim 1, further including impedance management means disposed on said conductors.

5. The communication plug of claim 4, wherein said impedance management means comprises a first plate disposed on one of said conductors and a second plate disposed on another of said conductors, said first and second plates being substantially parallel.

6. The communication plug of claim 5, further including means for separating said first and second plates.

7. The communication plug of claim 6, wherein said means for separating is a dielectric plastic spacer.

8. The communication plug of claim 6, wherein said means for separating is dielectric tape.

9. The communication plug of claim 1, wherein said first group comprises two conductor pairs and said second group comprises two conductor pairs.

10. The communication plug of claim 9, wherein said first group of conductors are interposed between said second group of conductors.

11. The communication plug of claim 9, further including impedance management means disposed on said conductors.

12. The communication plug of claim 11, wherein said impedance management means comprises a first plate disposed on a first said conductor and a second plate disposed on a second said conductor, said first and second plates being substantially parallel.

13. The communication plug of claim 12, wherein said first plate is disposed on one of said conductors in one of said conductor pairs and said second plate is disposed on the other one of said conductors in the same one of said conductor pairs.

14. A communication plug for terminating a cable carrying a plurality of wires, comprising:

a carrier having a top side, bottom side, a front end for engagement with a jack, and a back end for connection with the cable;

a plurality of electrical conductors disposed on said carrier, each of said conductors having a first end and a second end, at least one of said conductors extending from said back end, along said top side, around said front end, and terminating along said bottom side of said carrier such that its first end is disposed on said bottom side between said front end and said back end of the carrier, and at least one of said conductors extending from said back end, along said bottom side, around said front end, and terminating along said top side of said carrier such that its first end is disposed on said top side between said front end and said back end of the carrier, said conductors being configured for establishing an electrical connection with the wires in the cable;

means for fixing an impedance of said conductors; and a housing for receiving said carrier and having a plurality of slots formed therein through which said conductors can be engaged at said front end of said carrier by jack spring terminals of a jack when said plug is mated in the jack.

15. The communication plug of claim 14, wherein said means for fixing an impedance comprises a first plate disposed on a first one of said conductors and a second plate disposed on a second one of said conductors, said first and second plates being substantially parallel.

16. The communication plug of claim 14, wherein said means for fixing an impedance comprises first and second plates disposed in proximity to at least one of said conductors, said first and second plates being substantially parallel.

17. A communication plug for interconnecting a cable to a jack, said communication plug comprising:

a dielectric carrier, said carrier having a top side, a bottom side, a front end adapted to engage the jack, and a back end adapted to engage the cable;

first and second electrical conductors disposed on said carrier, each of said conductors having a first end and a second end, said first end of said first conductor being oriented adjacent said back end and said bottom side of said carrier, said first conductor extending along said bottom side of said carrier, around said front side of said carrier, and terminating on said top side of said carrier such that said second end of said first conductor is oriented between said front side of said carrier and said first end of said first conductor; and said first end of said second conductor being oriented adjacent said back end and said top side of said carrier, said second conductor extending along said top side of said carrier, around said front side of said carrier, and terminating on said bottom side of said carrier such that said second end of said second conductor is oriented between said front side of said carrier and said first end of said second conductor.

18. The communication plug of claim 17, wherein said plug has a first plate and a second plate arranged adjacent said bottom side of said carrier, said first and second plates being substantially parallel to each other and each electrically communicating with at least one of said conductors such that said first and second plates are configured to fix an impedance of said conductors.

19. The communication plug of claim 17, wherein said first conductor is one of a first group of conductors and said second conductor is one of a second group of conductors, and wherein said first group of conductors are interposed between said second group of conductors.

* * * * *